United States Patent [19]

Rodriguez-Torres

[11] Patent Number: 4,485,589

[45] Date of Patent: Dec. 4, 1984

[54] CONTROLLABLE DETENTION WINDOW

[75] Inventor: Wilfredo Rodriguez-Torres, Rio Piedras, P.R.

[73] Assignee: Architectural Affiliates, San Juan, P.R.

[21] Appl. No.: 411,872

[22] Filed: Aug. 26, 1982

[51] Int. Cl.[3] ..... E06B 7/02

[52] U.S. Cl. ..... 49/38; 49/50; 49/90; 49/95

[58] Field of Search ..... 49/77, 87, 88, 90, 50, 49/51, 95, 96, 38, 70; 98/99.8, 108

[56] References Cited

U.S. PATENT DOCUMENTS

| | | | |
|---|---|---|---|
| 411,972 | 10/1889 | Stoeppelwerth | 49/38 |
| 629,680 | 7/1899 | Hamalian | 49/88 |
| 1,050,010 | 1/1913 | Donnell | 49/90 X |
| 1,615,632 | 1/1927 | Kinneal | 49/88 |
| 1,950,218 | 3/1934 | Bierbach | 49/88 X |
| 1,986,713 | 1/1935 | Clark | 49/95 X |
| 2,123,751 | 7/1938 | Sigal | 49/38 |
| 2,474,152 | 6/1949 | Levy | 49/38 |
| 3,113,355 | 12/1963 | Tracy et al. | 49/50 |
| 3,412,506 | 11/1968 | Shiota | 49/87 X |
| 3,460,289 | 8/1969 | Toth | 49/50 |

*Primary Examiner*—Philip C. Kannan

*Attorney, Agent, or Firm*—Scrivener, Clarke, Scrivener and Johnson

[57] ABSTRACT

A window assembly for controlling light and ventilation and preventing undesired passage through the window opening has spaced horizontal fixed slats, spaced horizontal movable slats which may be moved vertically to partially or wholly close the spaces between the fixed slats, and vertically spaced tool steel bars extending across the window opening and anchored at their ends in the building structure in which the window assembly is mounted.

3 Claims, 7 Drawing Figures

CONTROLLABLE DETENTION WINDOW

SUMMARY OF THE INVENTION

A window structure assembly is anchored in the exterior wall of a building to provide a means for controlling water penetration, light and ventilation through the window while at the same time and with the same members preventing undesired human movement through it. The assembly is provided with vertically spaced fixed slats to prevent undesired human movement through it, and a unitary movable unit comprising vertically spaced slats which are connected to each other by means of a vertical rod located within a window structure jamb and is movable by an operating rod extending through the jamb to the interior of the window. A horizontal tool steel bar is positioned interiorly of each fixed slat and is connected at its ends to the building wall independently of the window assembly.

BACKGROUND AND OBJECTS OF THE INVENTION

Existing construction of detention windows for penal institutions, insane asylums, detention rooms, sanatoriums and the like include sash assemblies and detention bars independent of each other and, in some cases, sash assemblies in which the bars comprise an element of the sash itself. In more modern developments movable jalousies or shutter-like slats have also been incorporated with a separate or integrated bar assembly. The massiveness of the separate window and bar assembly, and the vandalism-prone multiple moving parts window assembly, with or without integral detention bars, cause undesirable complexity, promotes vandalism and increases maintenance operations and costs.

It is an object of this invention to provide a window construction in which by combining bars and jalousies and reducing moving parts to one, the massiveness of the structure is reduced, the opportunity for vandalism is reduced, and a bar assembly is provided which, because it is constructed of tool resistant steel anchored to the building structure independently of the anchoring of the window sash or jalousies, co-operates with the jalousies to provide security against undesired entry and prevents cutting of the bars.

By maintaining separation of the tool resistant detention bar assembly and fixed slats in the jalousie assembly, the need of making the fixed or movable slats of the jalousies of tool resistant steel is removed, and the fixed and movable slats can thus be bent and welded in position at the option of the user without the use of the tool resistant bar assembly, resulting in economy in fabrication and flexibility in use in addition to the economy of maintenance and discouragement to vandalism.

Another object of the invention is to provide fenestration with shading by fixed slats while providing ventilation through movable shutters which are joined together into one assembly, thus requiring only one moving part in the entire window. By making all fixed and movable slats of heavy gauge steel, the jalousie assembly itself provides a detention element in the window assembly and, by using a special slat shape, protection is afforded to the detention bars when the latter are used together with the jalousie assembly.

Another object of the invention is to provide a detention window without the tool resistant bar assembly, which has the same architectural design and shape as the detention window with a tool resistant bar assembly, the harmonious use of the two types of window in the same building being achieved with maximum protection where required and less protection where economy dictates or maximum security is not required.

Another object of this invention is to provide additional security to the building by anchoring the tool resistant bar assembly directly to the structure independent of the means for anchoring the window to the structure, this being achieved by a separate anchor for the bar assembly which is concealed within each window jamb.

Another object of the invention is to prevent the eroding and rusting of elements positioned within the jambs, including detention bar anchoring elements, by providing proper drainage, this being achieved by the use of a water collection channel and a weep hole at the lower part of each jamb to collect rain and other water and remove it to the exterior.

Another object of this invention is to construct the window frame so that the jalousie parts and tool-resistant bar parts may be readily and efficiently assembled, this being accomplished by punching the window jambs at modularly spaced distances to receive tabs on the fixed slats, thus providing a fixed jig joint prior to welding the slats in place or assembling the tool-resistant bars within the window. Factory assembly of the jalousie window is thus simplified and cost is reduced.

Another object is to shape the cross section of the horizontal fixed jalousies slats in such a way as to increase resistance to lateral bending in any direction, thus providing stability of tolerances and reducing vandalism, the cross sectional shape thus also providing shape and diversion of rain water.

These objects of the invention can be applied to a jalousie window having extruded aluminum shapes interconnected to form an aluminum components jalousie detention window with only one moving part and capable of receiving a separately built and assembled tool-resistant steel bar protection grille for maximum custody. The use of aluminum in the aluminum version of the detention window of the invention reduces the weight of the window as a whole and increases the resistance to weather deterioration.

Further objects of this invention will be apparent from the description of preferred embodiments of the invention which is set forth in this specification.

DESCRIPTION OF THE INVENTION

It is the principal object of this invention to provide a window construction which may be anchored as a unit in the masonry wall of a building and which will include means for controlling the passage of rainwater, air, light and human passage from the outside into the room into which the window opens and, in addition, to provide means anchored to the masonry wall of the building and extending across the window opening which will prevent undesired passage of a human being through the window opening, thereby increasing the security of the building. In accordance with the invention the means for anchoring the window to the wall are independent of the means for anchoring the detention bars to the wall.

Figure 1:
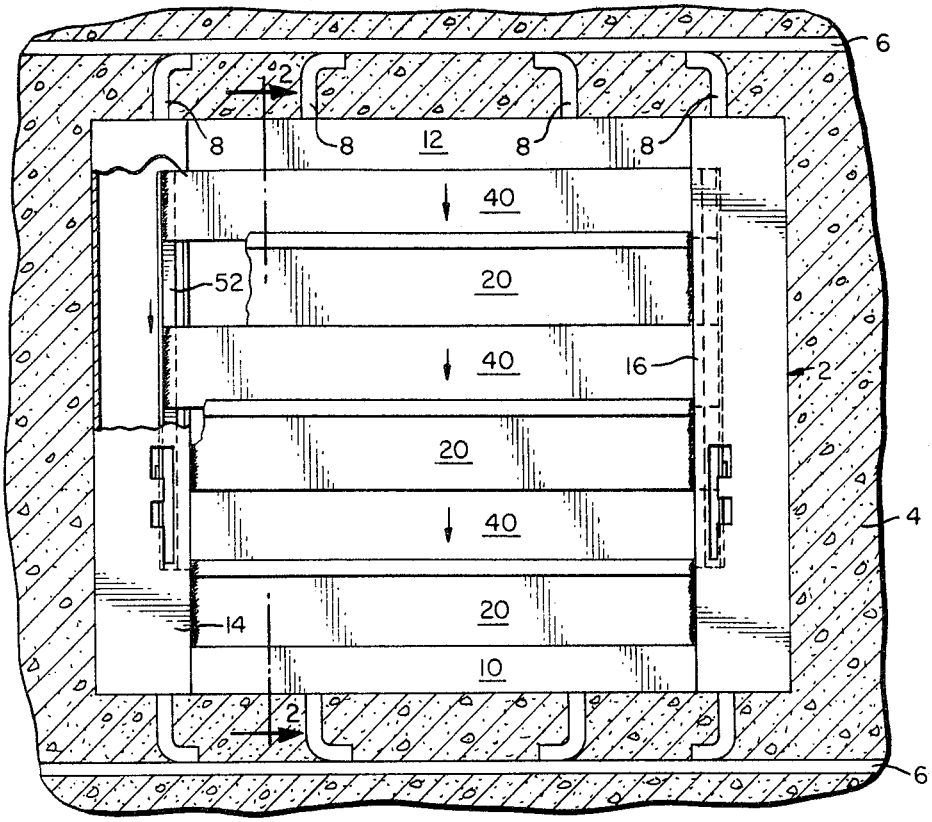
FIG. 1 is an elevational view of a window construction according to the invention in association with the masonry wall of a building.
Figure 2:
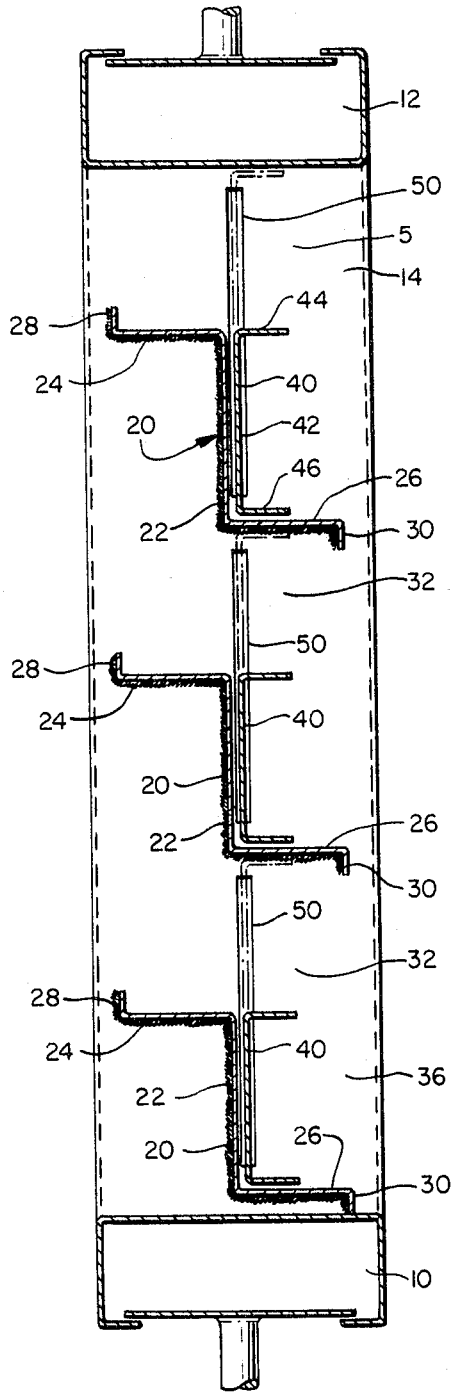
FIG. 2 is a vertical sectional view taken on line 2—2 of FIG. 1.
Figure 5:
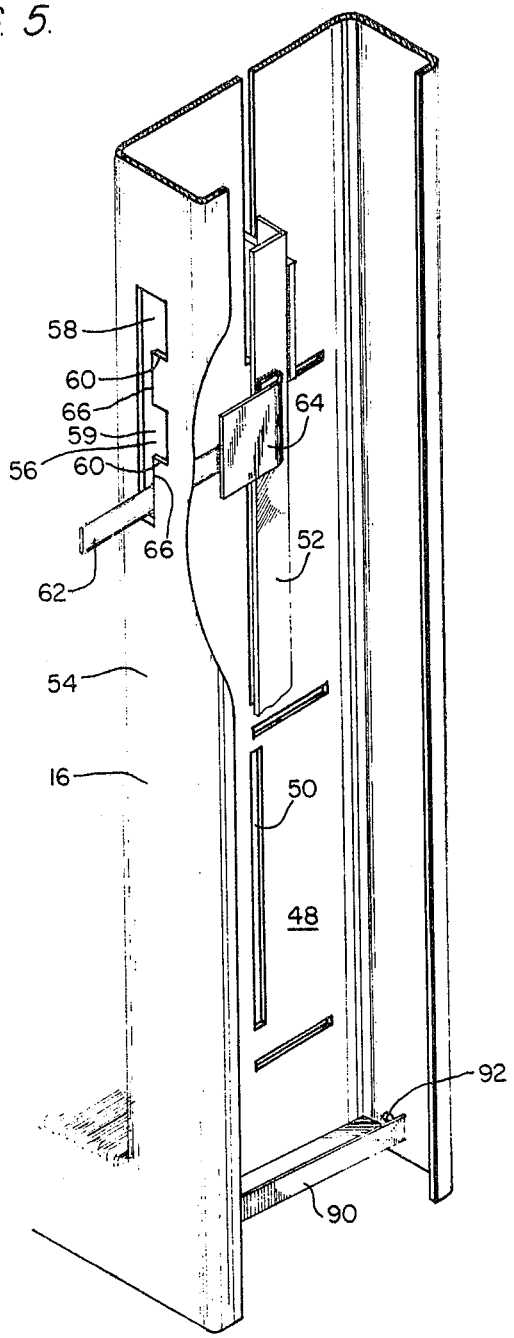
FIG. 5 is an isometric view of one of the jambs of a window according to the invention showing the operating means for the movable slats.

A first embodiment of the invention is disclosed in FIGS. 1, 2 and 5 in which there is disclosed a rectangular window frame denoted generally at 2 which is mounted in the masonry wall 4 of a building, which may be residential or commercial, and to which the frame is anchored by welding steel members 8 to the window frame and to structural steel members 6 embedded in the wall, after which the frame is grouted in place. The window frame comprises a sill 10 a header 12 and jambs 14, 16 both of which are hollow for purposes to be explained and described.

Figure 4:
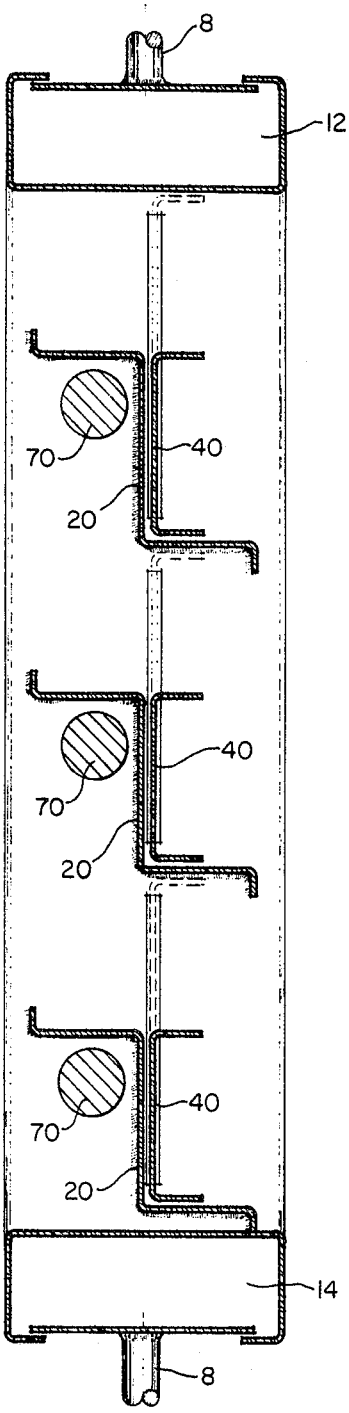
FIG. 4 is a vertical sectional view taken on line 4—4 of FIG. 3.

Means are provided by the invention for controlling the passage of rainwater, light and air through the opening defined by the four members which constitute the window frame, and such means comprise a plurality of fixed slats and a plurality of movable slats, which are best disclosed in FIGS. 1, 2 and 4. Each of the fixed slats 20 extends horizontally across the window opening from jamb to jamb and each is connected at its ends to the adjacent jamb by welding. These slats are arranged in spaced vertical relation from the sill to the header and each has a vertical member 22 of substantial height, a horizontal part 24 which is integrally connected to the upper edge of the vertical part 20 and extends inwardly of the window, and a second horizontal part 26 which is integrally connected to the lower edge of the vertical part and extends outwardly of the window. At the outer edge of horizontal part 24 there is integrally formed an upwardly extending flange 28 which extends from end to end of the slat, and at the outer edge of the lower horizontal member 26 of each slat there is provided an integrally formed downwardly extending flange 30. The fixed slats are spaced vertically within the window frame opening, leaving open spaces between them which are indicated by the numeral 32 and an opening which is located between the upper fixed slat and the header 12.

Means are provided by the invention for partially or wholly closing the spaces between the fixed slats and the space between the upper fixed slat and the header of the window frame, and such means comprise a plurality of vertically movable slats 40 each of which is channel shaped in cross section having a vertical part 42 and upper and lower horizontal flanges 44, 46 which extend outwardly of the frame from the vertical part 40. Each of the vertical parts 40 has substantially the same vertical length as the vertical part 20 of each of the fixed slats and in the open position of the movable slats the vertical parts of the two slats lie in side-by-side relation, as most clearly shown in full lines in FIG. 2, with the upper and lower horizontal flanges of the movable slats extending in the same direction as the lower horizontal member 26 of the adjacent fixed slat.

Means are provided by the invention for simultaneously moving the movable slats 40 to adjusted positions in which they fully or partially open or close the spaces between the fixed slats and between the upper fixed slat and the window frame header, and in accordance with the invention these means are enclosed within each of the two jambs of the window frame and are operated by means projecting from each jamb to the interior of the building. Such means comprise, first, a plurality of vertical openings 50 in the inner wall 48 of the jambs of the window frame, and through each of which an end of a movable slat extends into the interior of the adjacent jamb where it, together with all of the movable slats of the window, is connected to a vertical rod 52. It will be seen that by vertical movement of the rod 52 to any desired position the movable slats may be raised or lowered by any desired amount thereby to control the opening between the fixed slats and the opening between the upper fixed slat and the window frame header.

Means are provided for imparting vertical movement to the rod 52, and such means are particularly shown in FIG. 5 in which there is illustrated the right hand jamb 16 of a window frame having the front wall 54 which is provided with a vertical opening 56 which has an enlarged upper part 58 and an enlarged intermediate part 59 each of which has a lower horizontal detent surface 60. An operating handle 62 extends through the opening 56 to the interior of the jamb and at its inner end is connected within the jamb to the vertical rod 52 through a resilient U-shaped member 64, one leg of which is connected to the rod 52, the member 64 being so constructed and arranged that it constantly urges the operating rod 62 into engagement with the outer vertical edge 66 of the opening 56 thereby providing a frictional detent action as the operating rod is moved from one to the other of the detent surfaces 60. Both jambs of the window frame have the same operating and detent means for the movable slats, as is clearly shown in FIGS. 1 and 3.

Figure 3:
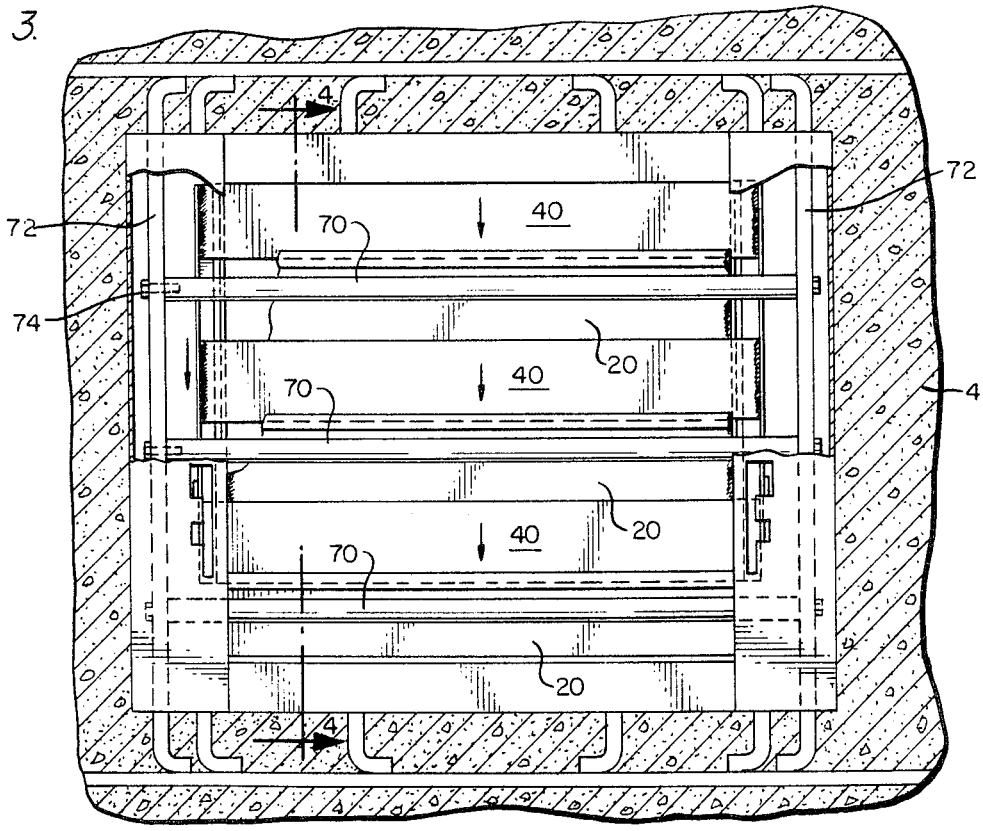
FIG. 3 is an elevational view similar to FIG. 1 and shows the security bars provided by the invention.

The fixed slats 20 prevent undesired human access through the window and additional means are also provided by the invention for preventing undesired human access through the window, and such means are particularly shown in FIGS. 3 and 4. In this embodiment of the invention a plurality of hardened tool steel bars 70 extend in vertically spaced relation across the window frame opening into the side jambs where an end of each bar is anchored to the masonry by means of a vertical steel bar 72 which is positioned within the jamb of the window frame and to which the end of each bar is attached by bolt 74. Each bar 72 has its upper and lower parts and ends embedded in the masonry wall outside the window frame, whereby the bars 70 are anchored to the wall independently of the anchoring of the window frame to the wall. As most clearly illustrated in FIG. 4, each of the bars 70 is preferably positioned within the vertical confines of a fixed slat and immediately below the lower surface of the upper horizontal member 24 of one of the fixed slats.

Figure 6:
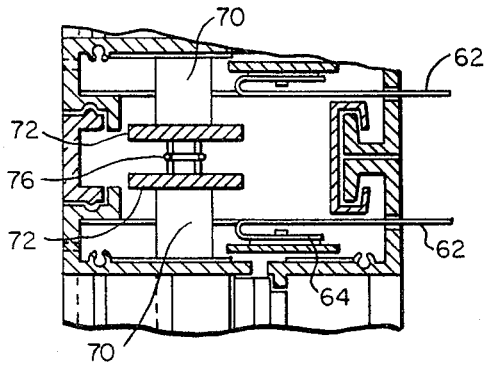
FIG. 6 is a horizontal sectional view showing the jambs of two windows which are arranged in side by side relation.

If two windows are placed side by side with their adjacent jambs together, the ends of aligned security bars 70 will be welded together. This connection is illustrated in FIG. 6 in which there are also shown the operating handle 62, the resilient member 64 and the embedded rods 72 to which the security bars 70 are connected.

As shown in FIG. 5, a weep channel 90 may be provided at the base of each jamb of the window frame where it will receive rain or other water passing over the horizontal and vertical parts of each of the fixed slats when the movable slats are partially or fully open. The water so collected will pass to the exterior of the window frame through a weep hole 92.

Figure 7:
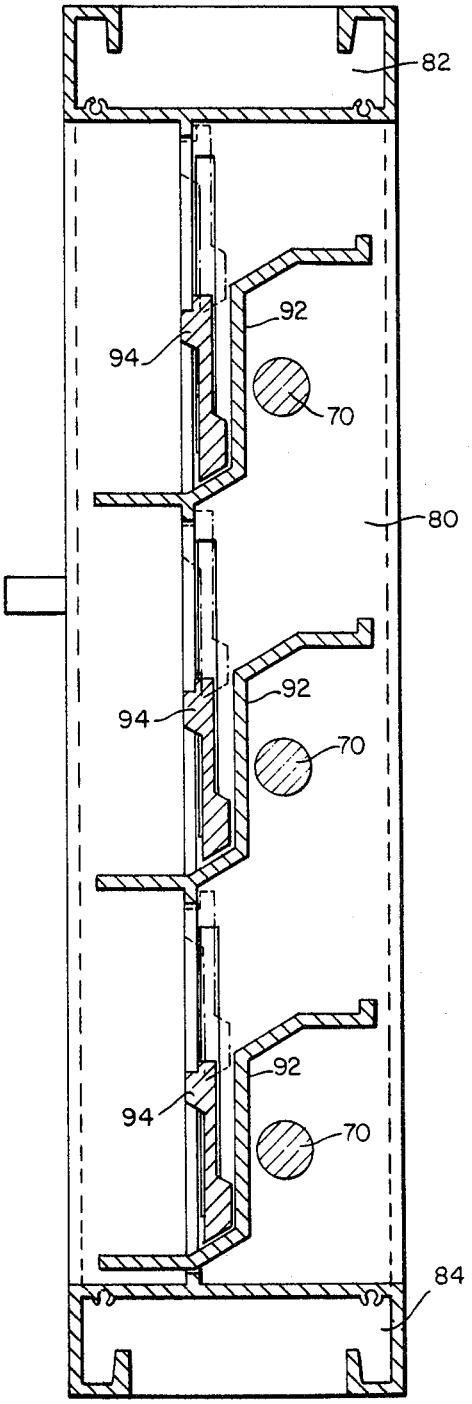
FIG. 7 is a vertical sectional view showing a modified form of the invention.

It will be understood that within the scope of the invention other configurations of the various parts of the window assembly may be made and used, and that various materials may be used in the manufacture of these parts. For example, in FIG. 7 there is disclosed the side jamb 80, the header 82 and the sill 84 of a window frame together with the security bars 70. In this embodiment each of the fixed slats 92 and each of the movable slats 94 is made of extruded aluminum, whereas the corresponding parts as illustrated in FIGS. 1 to 6 may be made of formed sheet metal.

In addition, the fact that the tool steel security bars 70 are separate and independent of the fixed slats permits the slats to be made of a material less expensive than the steel of which the security bars are made. Therefore, the slats may be bent from sheet metal or extruded from aluminum without the necessity of forming them of the tool steel, while retaining the security feature provided by the bars.

I claim:

1. A window assembly for controlling rainwater, light, ventilation and access through the masonry wall of a building, comprising:

(a) a rectangular frame having a hollow jamb at each side, a sill and a header parallel to the sill, all defining a central opening.

(b) a plurality of fixed horizontal slats arranged in vertically spaced relation within the window opening, each of which is permanently connected to the jambs at its ends, (c) each of the fixed slats comprising a vertical part, a first horizontal part extending inwardly of the window from the upper edge of the vertical part, and a second horizontal part extending outwardly of the window from the lower edge of the vertical part, (d) a weep channel in the base of the jamb positioned to receive rainwater passing over a fixed slat, and a weep hole through the jamb and below the channel to pass rainwater from the channel to the exterior of the jamb, (e) a plurality of movable slats extending horizontally across the central opening of the frame in vertically spaced relation each having a part at each end extending into the adjacent jamb through an elongated vertical opening in the jamb thereby permitting vertical sliding movement within the frame, (f) each of said movable slats being normally positioned in horizontal alignment with a fixed slat and being C-shaped in cross section with a vertical part having approximately the same height as the vertical part of the adjacent fixed slat, and two horizontal flanges extending outwardly of the window from the upper and lower edges of the vertical part, respectively, the lower horizontal flange being positioned above and spaced from the outwardly extending flange of the aligned fixed slat.

(g) a single means in each jamb for simultaneously moving the movable slats, comprising a vertical rod within each jamb connected to all of the movable slats, and operating handles connected to the vertical rods and projecting to the exterior of the jambs through elongated vertical opening therein, and (h) a plurality of vertically spaced horizontally tool steel detention bars extending across the window opening with their ends within the jambs, each bar being horizontally aligned with and inside of a fixed slat.

2. A window assembly according to claim, 1 in which each fixed slat is constructed so that the horizontal part connected to the upper edge of the vertical part has an upwardly extending flange along its inner edge, and the horizontal part connected to the lower edge of the vertical part has a downwardly extending flange along its outer edge.

3. A window assembly according to claim 1, in which the ends of each detention bar extend into the window jambs, a vertical rod positioned within each jamb and a permanent connection, such as welding, between each end of each bar and the adjacent rod, the upper and lower ends of each rod being embedded in the building wall independently of the connection of the window assembly to the wall.

* * * * *